US011788806B2

(12) United States Patent
Jeong et al.

(10) Patent No.: US 11,788,806 B2
(45) Date of Patent: Oct. 17, 2023

(54) TURBULATOR FOR HEAT EXCHANGER

(71) Applicant: KYUNGDONG NAVIEN CO., LTD., Pyeongtaek-si (KR)

(72) Inventors: In Chul Jeong, Seoul (KR); Jun Gil Park, Seoul (KR); Seong Sik Moon, Seoul (KR)

(73) Assignee: Kyungdong Navien Co., LTD., Pyeongtaek-si (KR)

( * ) Notice: Subject to any disclaimer, the term of this patent is extended or adjusted under 35 U.S.C. 154(b) by 47 days.

(21) Appl. No.: 17/370,910

(22) Filed: Jul. 8, 2021

(65) Prior Publication Data

US 2022/0018616 A1 Jan. 20, 2022

(30) Foreign Application Priority Data

Jul. 20, 2020 (KR) ..... 10-2020-0089890

(51) Int. Cl.

| | |
|---|---|
| ***F28F 13/12*** | (2006.01) |
| ***F28D 1/053*** | (2006.01) |
| ***F24H 9/00*** | (2022.01) |
| *F28F 1/02* | (2006.01) |

(52) U.S. Cl.

CPC ..... *F28F 13/12* (2013.01); *F24H 9/0026* (2013.01); *F28D 1/05383* (2013.01); *F28F 1/02* (2013.01)

(58) Field of Classification Search

CPC ..... F28F 13/12; F28F 1/40; F24H 9/0026

See application file for complete search history.

(56) References Cited

U.S. PATENT DOCUMENTS 4,262,659 A * 4/1981 Brzezinski ..... F24S 70/65 165/170

2015/0308756 A1* 10/2015 Lee ..... F28F 1/40 165/109.1

FOREIGN PATENT DOCUMENTS

| | | |
|---|---|---|
| CN | 109059294 A | 12/2018 |
| KR | 1019980010326 | 4/1998 |
| KR | 1020130017815 | 2/2013 |
| KR | 1020180011613 | 2/2018 |

* cited by examiner

*Primary Examiner* — Eric S Ruppert

(74) *Attorney, Agent, or Firm* — ALG Intellectual Property, LLC

(57) ABSTRACT

According to an aspect of the present disclosure, a turbulator inserted into a tube of a heat exchanger, when it is assumed that the water flows horizontally along a water flow direction along the tube and a combustion gas flows vertically from an upper side to a lower side to cross the tube, and a direction that is perpendicular to both the water flow direction and an upward/downward direction is defined as a leftward/rightward direction, a body part extending along the water flow direction, having a plate shape that is perpendicular to the leftward/rightward direction, and inserted into the tube, and an upstream side wing part protruding from an upstream side portion of the body part with respect to the water flow direction along at least one direction of the leftward/rightward direction and extending in a direction that is inclined upwards with respect to the water flow direction.

11 Claims, 15 Drawing Sheets

140

TURBULATOR FOR HEAT EXCHANGER

CROSS-REFERENCE TO RELATED APPLICATION

This application claims the benefit of priority to Korean Patent Application No. 10-2020-0089890, filed in the Korean Intellectual Property Office on Jul. 20, 2020, the entire contents of which are incorporated herein by reference.

TECHNICAL FIELD

The present disclosure relates to a turbulator for a heat exchanger.

BACKGROUND

A water heater that heats water to discharge warmed water or for heating generally achieve its object by receiving a fuel, burning the fuel, and transferring heat generated therefrom to water.

A heat exchanger is used to transfer the heat generated by the water heater to the water. Among various kinds of heat exchangers, a tube type heat exchanger, in which heat is transferred to heating water as a tube is heated by the generated heat while the heating water to be heated flows through the tube.

A portion of the tube, through which the heating water flows, may be located adjacent to a heat source that generates heat. As compared with the amount of heat received by the other portions of the tube, which are far from the heat source, the amount of heat received by the portion from the heat source may be much larger. Accordingly, overheating may occur at the portion of the tube, which is adjacent to the heat source. As the tube is locally heated, the water may be boiled and vibration and boiling noise may be generated.

Meanwhile, a turbulator that may make the heating water turbulent by hindering the flows of the heating water may be disposed in the interior of the tube to make the heating water turbulent.

SUMMARY

The present disclosure has been made to solve the above-mentioned problems occurring in the prior art while advantages achieved by the prior art are maintained intact.

An aspect of the present disclosure provides a turbulator that may hinder local overheating and a heat exchanger for a water heater.

The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, a turbulator inserted into a tube of a heat exchanger that heats water through heat exchange with a combustion gas for turbulence of the water includes, when it is assumed that the water flows horizontally along a water flow direction along the tube and the combustion gas flows vertically from an upper side to a lower side to cross the tube, and a direction that is perpendicular to both the water flow direction and an upward/downward direction is defined as a leftward/rightward direction, a body part extending along the water flow direction, having a plate shape that is perpendicular to the leftward/rightward direction, and inserted into the tube, and an upstream side wing part protruding from an upstream side portion of the body part with respect to the water flow direction along at least one direction of the leftward/rightward direction and extending in a direction that is inclined upwards with respect to the water flow direction such that the water is guided to an upper side of the body part.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
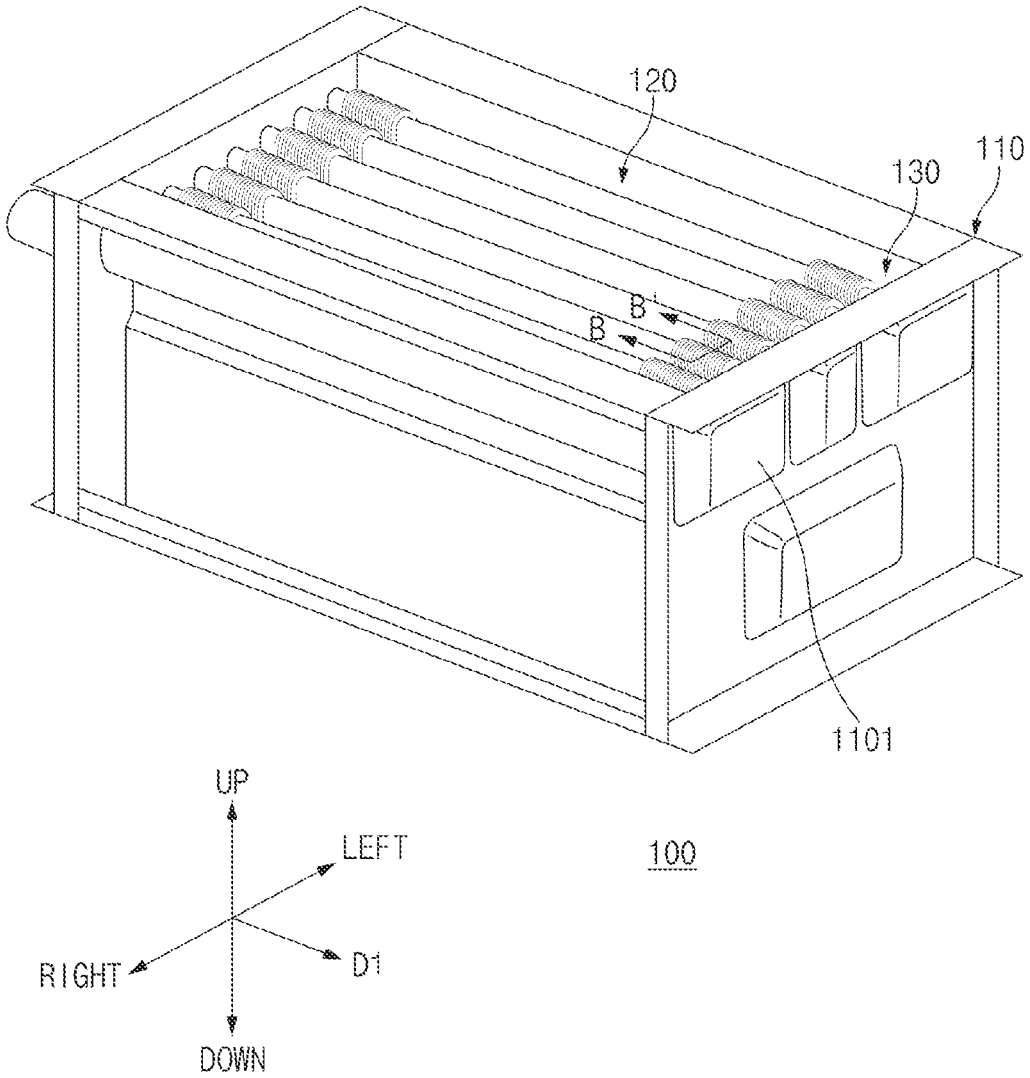
FIG. 1 is a perspective view of an exemplary heat exchanger for a water heater.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of the related known configuration or function will be omitted when it is determined that it interferes with the understanding of the embodiment of the present disclosure.

In describing the components of the embodiment according to the present disclosure, terms such as first, second, A, B, (a), (b), and the like may be used. These terms are merely intended to distinguish the components from other components, and the terms do not limit the nature, order or sequence of the components. Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
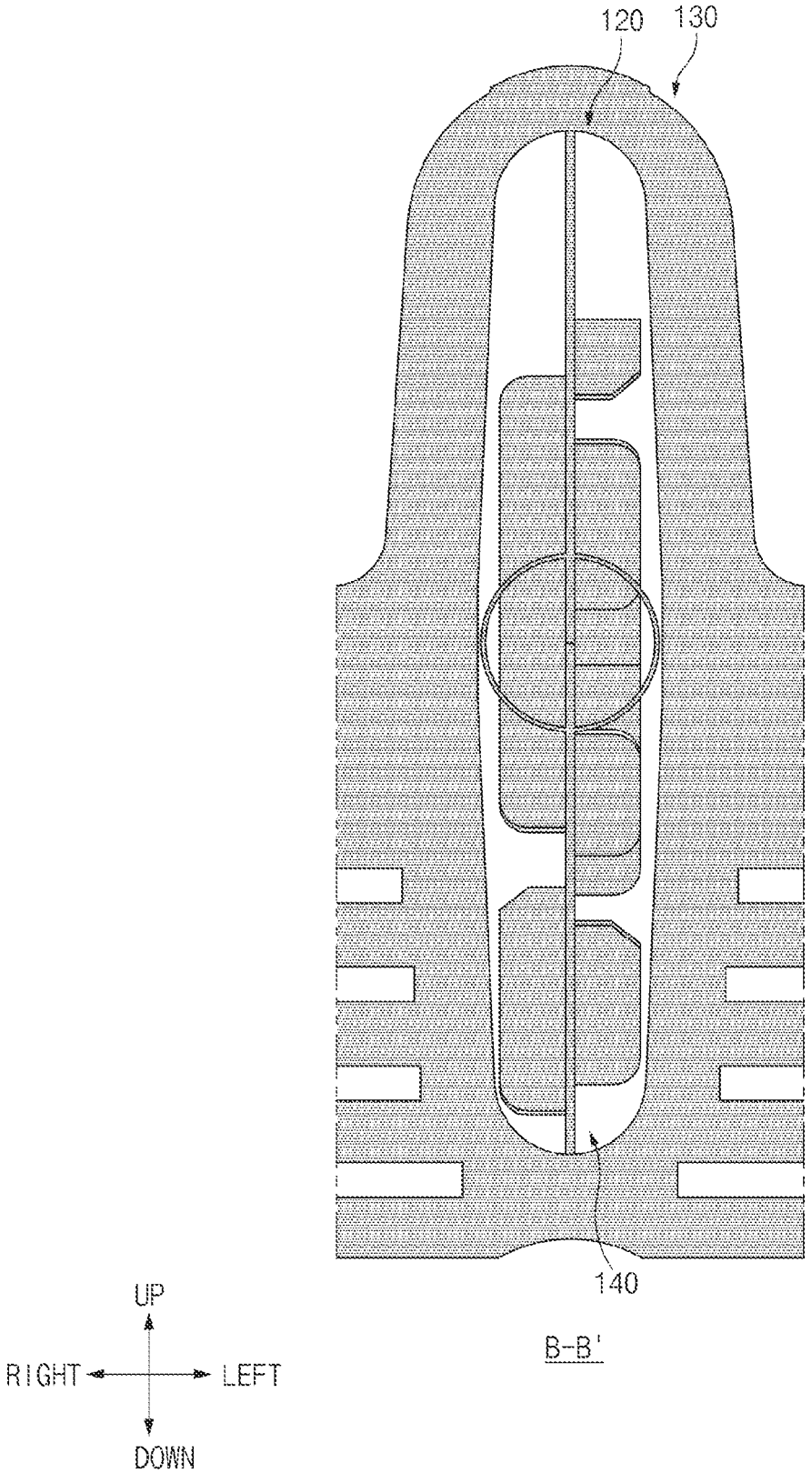
FIG. 2 is a view illustrating an exemplary tube and an exemplary turbulator.

FIG. 1 is a perspective view of an exemplary heat exchanger 100 for a water heater. FIG. 2 is a view illustrating an exemplary tube 120 and an exemplary turbulator 140. FIG. 2 also is a view illustrating cross-section B-B' of FIG. 1.

Referring to FIGS. 1 and 2, an exemplary heat exchanger 100 for a water heater is an apparatus that heats water through heat exchange with a combustion gas, and may include a tube 120, a pin 130, and a turbulator 140, and may further include a case 110. The tube 120 may extend along a direction that enters and exits the drawing of FIG. 2, and water may flow through an interior of the tube 120. An exemplary turbulator 140 may be disposed in the interior of the tube 120. The turbulator 140 is disposed such that the water flowing in the tube 120 becomes turbulent.

In the specification of the present disclosure, it is assumed that the water flows horizontally along the tube 120 along a flow direction D1 of the water and the combustion gas flows vertically from an upper side to a lower side to cross the tube 120. Furthermore, it is assumed that a direction that faces the left side and the right side when the turbulator 140 is viewed along the water flow direction D1 is a leftward/rightward direction. The leftward/rightward direction may be a direction that is perpendicular to both the water flow direction D1 and the upward/downward direction. The water flow directions D1 of adjacent tubes 120 are parallel to each other but may be opposite to each other.

The definition of the directions is exemplarily used to describe the heat exchanger 100 for a water heater and the turbulator 140 located in an interior thereof, but may be changed according to a disposition of the water heater.

The tube 120 is an element configured such that the water flows in the interior thereof, and as illustrated, may extend along the water flow direction D1, and a plurality of tubes 120 may be disposed in the heat exchanger 100 along the leftward/rightward direction. The turbulator 140 is inserted into the tube 120 for turbulence of the water.

A height of the tube 120 with respect to the upward/downward direction is larger than a width of the tube 120 with respect to the leftward/downward direction, and may be a flat tube having a flat shape.

The plate-shaped pin 130 is an element configured to pass through the tube 120, and a plurality of pins 130 may pass through one tube 120. The plurality of pins 130 may be arranged along the water flow direction D1, and the pins 130 may be disposed in a central area of the tube 120, which is not illustrated.

The case 110 is an element that forms a space, in which the combustion gas flows, and acts as a frame, by which the tube 120 may be fixed. Although the case 110 may have a box shape that is opened in the upward/downward direction as illustrated, the shape of the case 110 is not limited thereto.

Opposite ends of the tube 120 may pass through an outer wall located on opposite sides of the case 110 along the water flow direction D1, and a plate for a passage cap 1101 may be disposed to cover opposite ends of the tube 120. The passage cap 1101 of the plate for the passage cap 1101 may connect distal ends of at least two adjacent tubes 120 such that the water flowing through the tube 120 may be delivered to another adjacent tube 120 via the passage cap 1101, whereby a whole passage may be formed. However, a method for forming the passage is not limited thereto.

The case 110 may be disposed on a lower side of a burner that generates heat and generates the combustion gas. Accordingly, the combustion gas may flow through an opening formed on an upper side of the case 110 and may be disposed to an opening formed on a lower side of the case 110. In this way, as the combustion gas flows while passing through an interior of the case 110, the tube 120 and the pin 130 exchange heat with the combustion gas and the water flowing through the interior of the tube 120 may receive the heat of the combustion gas. Sensible heat generated by the burner and latent heat generated when the combustion gas is condensed may be further transferred to the water through the tube 120. Via the process, the water introduced into the heat exchanger 100 may be discharged after being heated. The discharged water may be discharged to the outside through a faucet or the like, and may circulate through a heating passage to be used for heating.

However, the above description is regarding the heat exchanger 100 of a downstream type water heater, in which the combustion gas is exemplarily flows downwards, a disposition direction and a sequence thereof, and the disposition direction and the sequence thereof may be opposite in an upstream type heat water heater.

Figure 3:
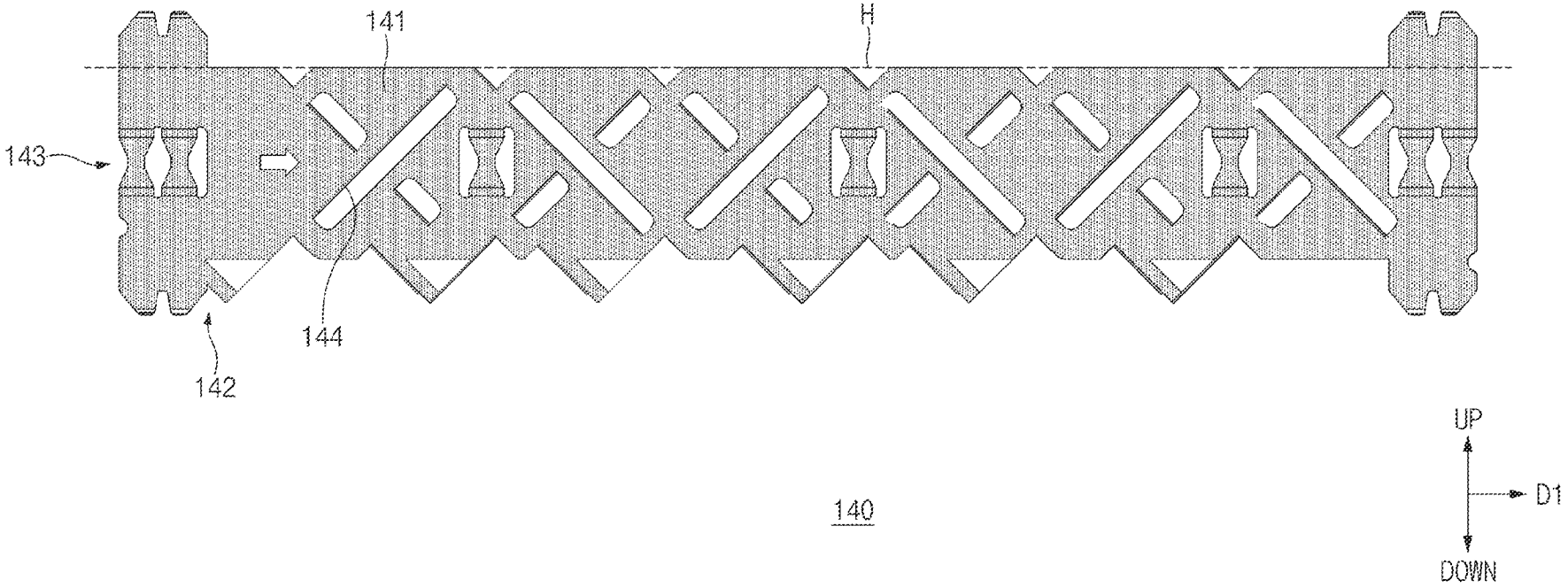
FIG. 3 is a side view of an exemplary turbulator.
Figure 4:
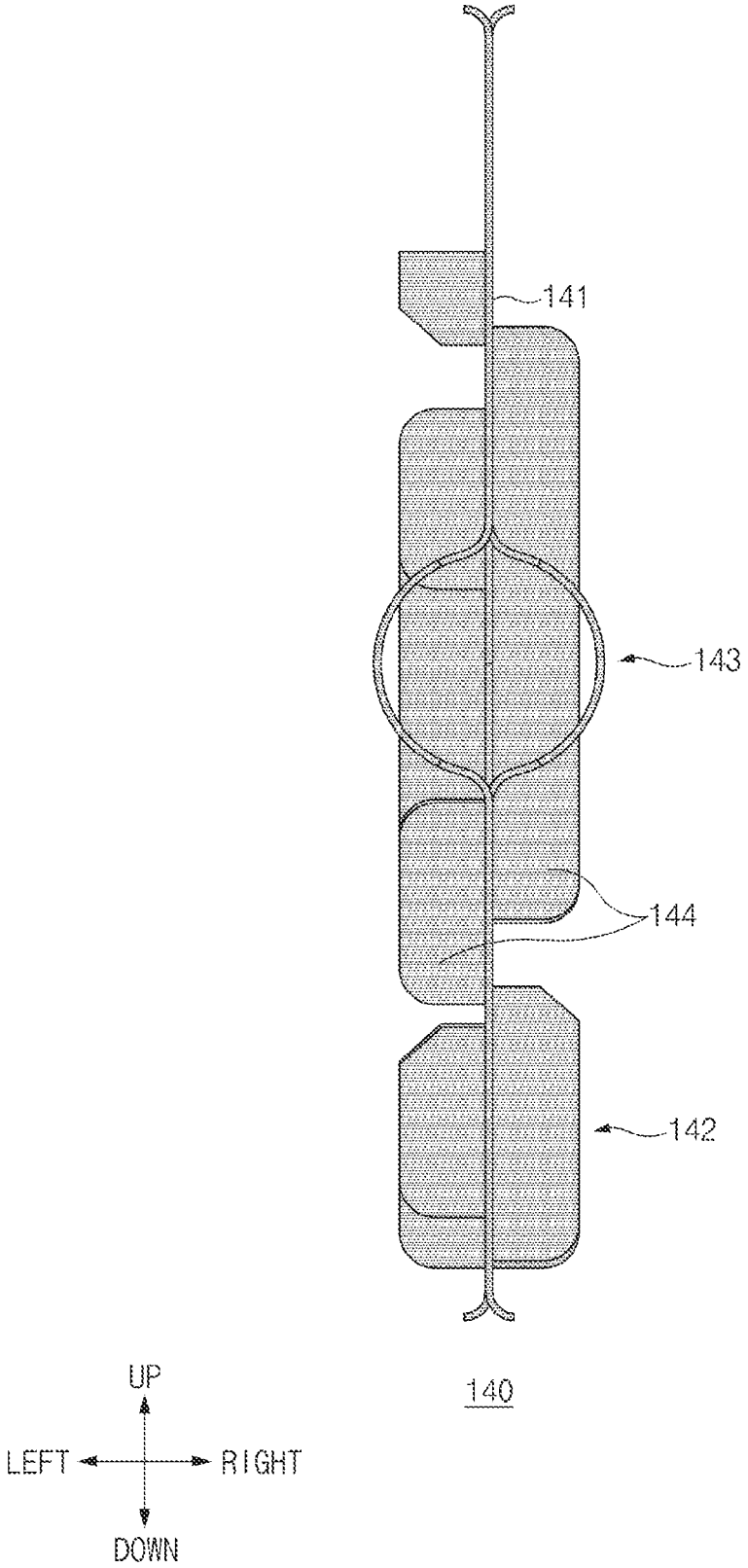
FIG. 4 is a front view of an exemplary turbulator.

FIG. 3 is a side view of an exemplary turbulator 140. FIG. 4 is a front view of an exemplary turbulator 140.

The tube 120 and the exemplary turbulator 140 may be identified from FIGS. 3 and 4. It may be seen that a border of the turbulator 140 is formed along a horizontal line H extending along the water flow direction D1, except that an upper end of the body part 141 extending along the water flow direction D1 has a recess recessed on the lower side in a 'V' shape. It may be seen that a hole that is opened along the leftward/rightward direction is formed at a protrusion 142 formed to protrude from an upstream side lower end of the body part 141 to the lower side in the water flow direction D1. It may be seen that a leftward/rightward support part 143 protrudes convexly from the body part 141 along the leftward/rightward direction. Furthermore, it may be seen that a plurality of wings 144 that protrude from the body part 141 along the leftward/rightward direction are disposed and are disposed to cross each other while being inclined upwards and downwards with respect to the water flow direction D1.

As described above, in the heat exchanger in a situation, in which the combustion gas flows from the upper side to the lower side of the tube 120, it may be predicted that the water flowing in a flow area formed on the upper side of the body part 141 of the exemplary turbulator 140 disposed to be adjacent to an upper end of the tube 120 may be overheated. A flow rate of the water flowing to the flow area may be decreased so that local overheating may occur. In particular, the water introduced to be adjacent to a lower end of the turbulator 140 may flow while crossing the hole formed in the protrusion 140 leftwards and rightwards and may be left to be adjacent to the lower end of the turbulator 140 because there is no configuration for guiding the flows of the water to the upper side. Accordingly, because the water is not sufficiently supplied to the upper end of the turbulator 1, it may be overheated.

Figure 5:
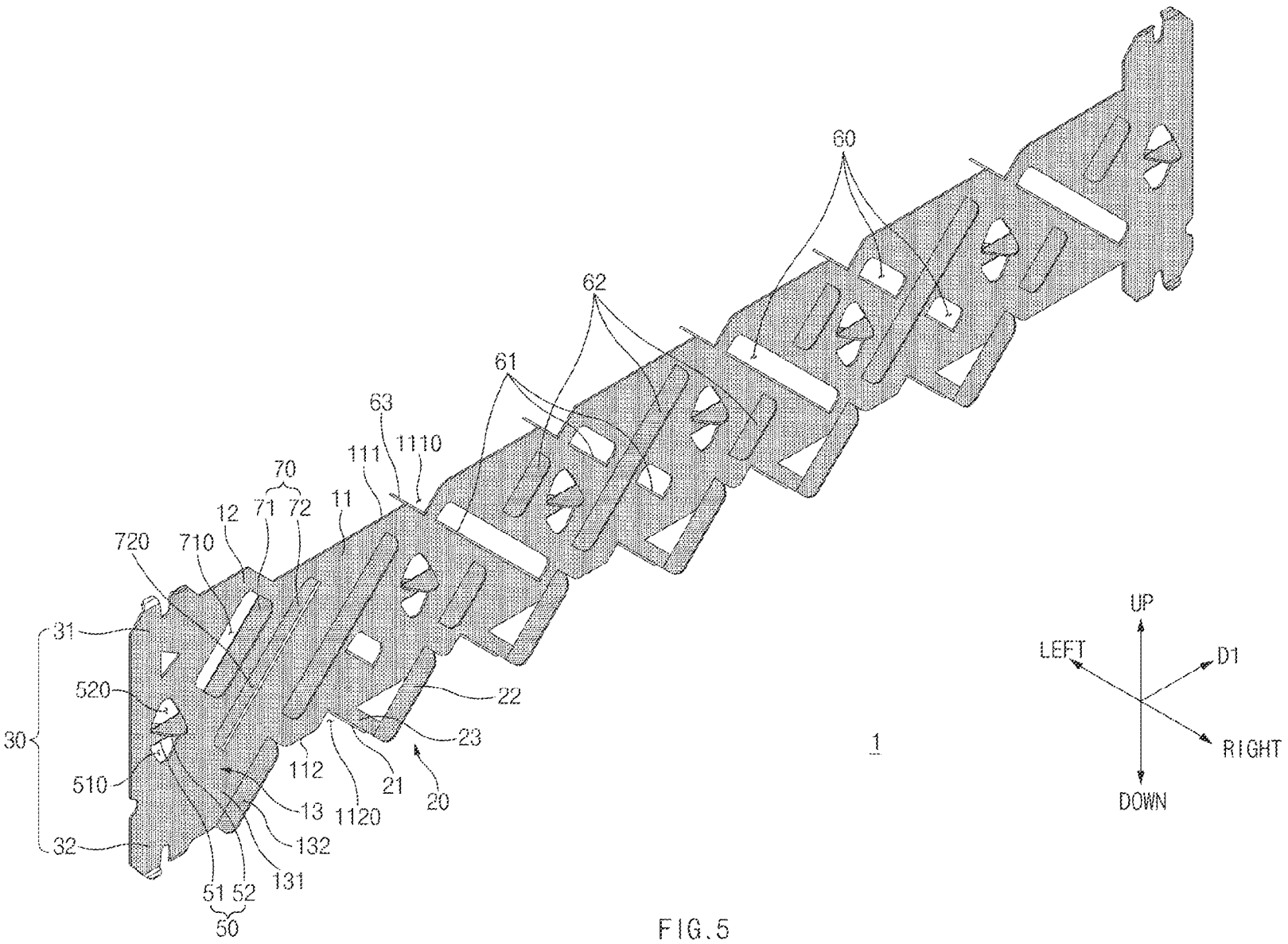
FIGS. 5 and 6 are perspective views of a turbulator according to an embodiment of the present disclosure.
Figure 6:
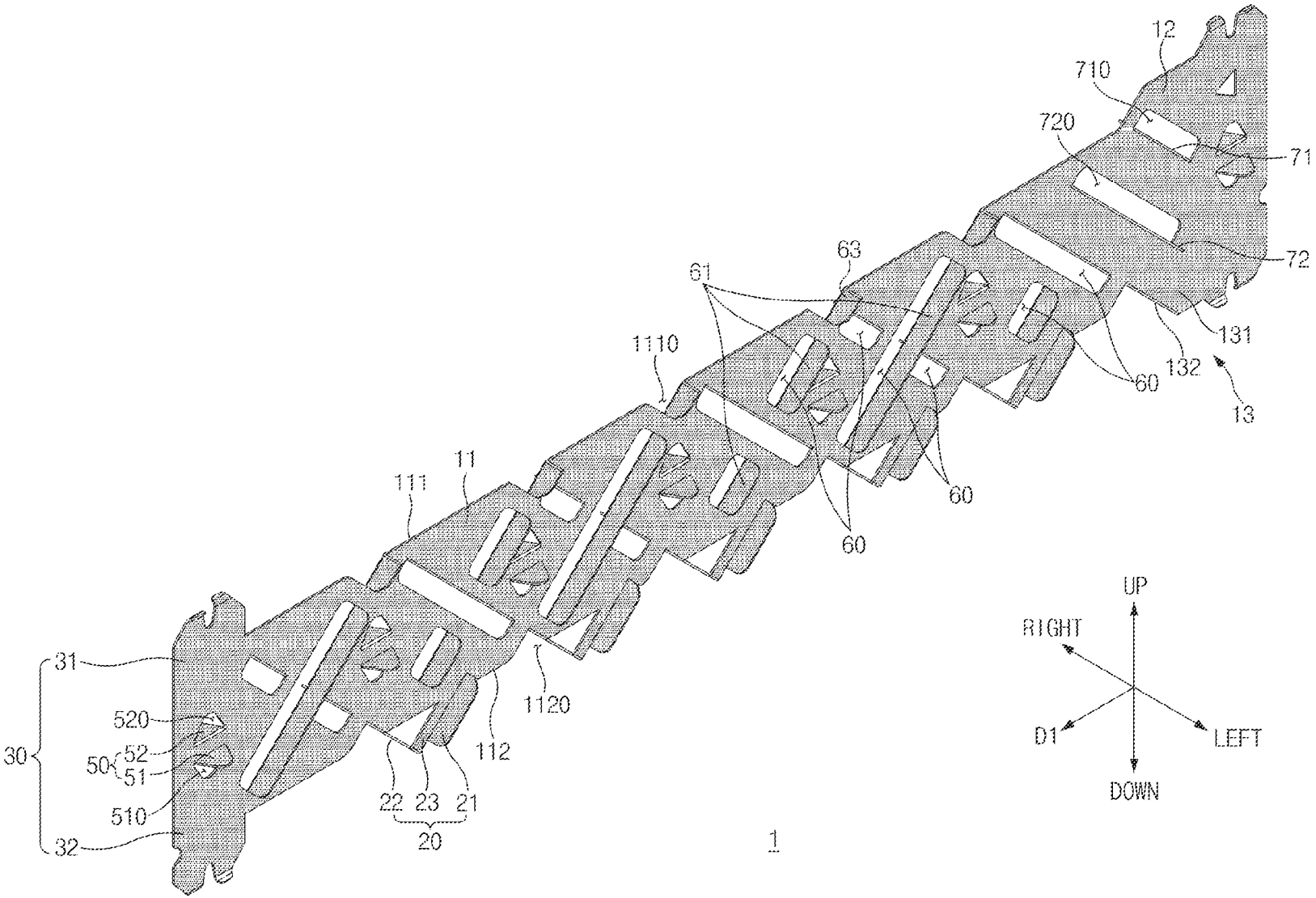
Figure 7:
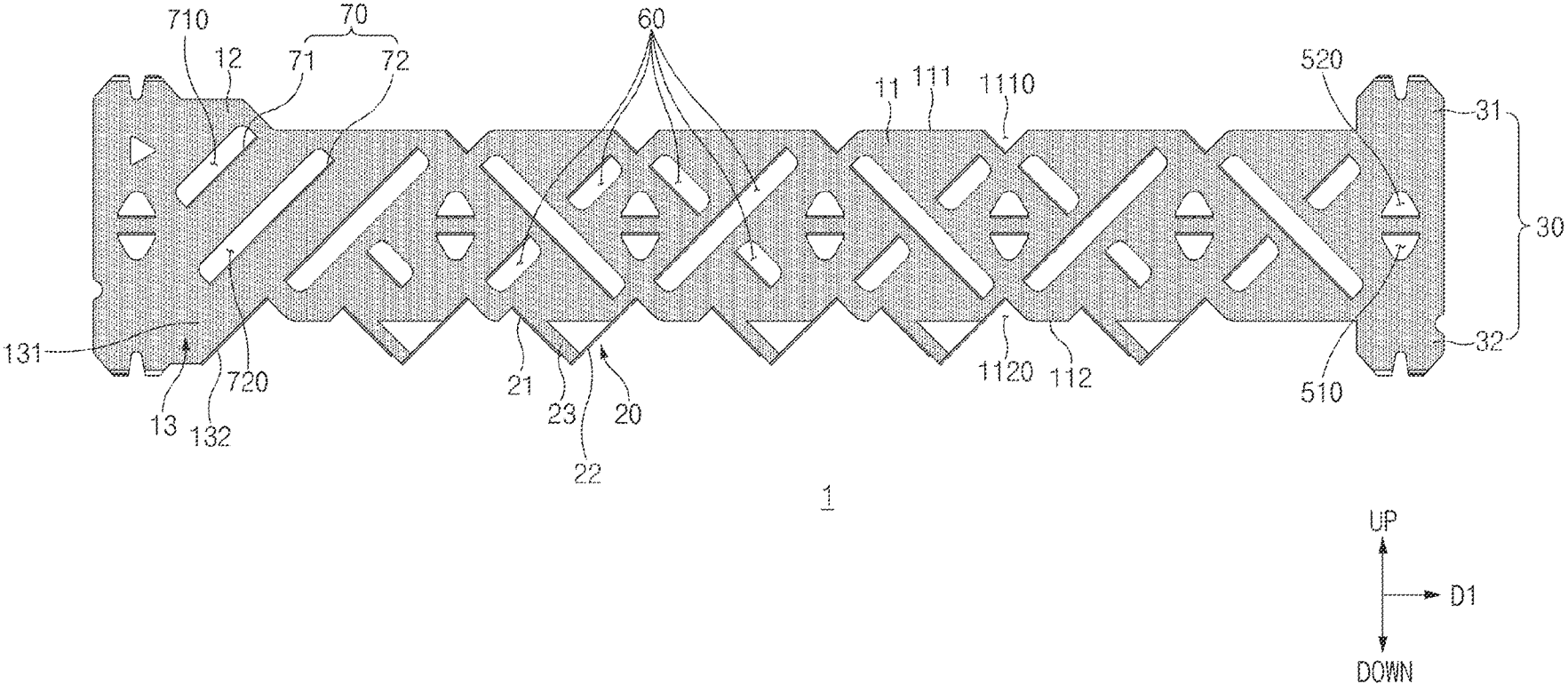
FIG. 7 is a side view of a turbulator according to an embodiment of the present disclosure.
Figure 8:
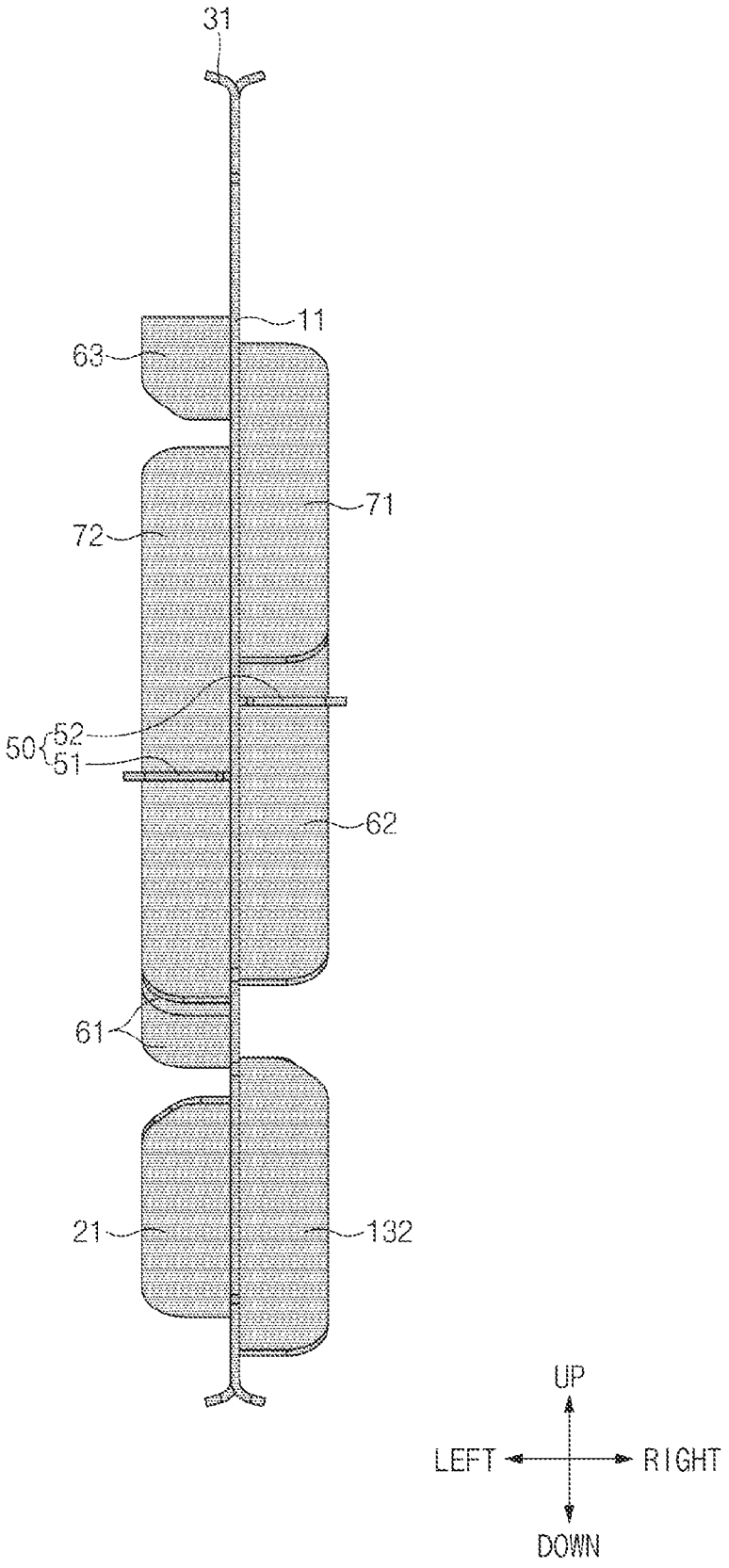
FIG. 8 is a front view of a turbulator according to an embodiment of the present disclosure.
Figure 9:
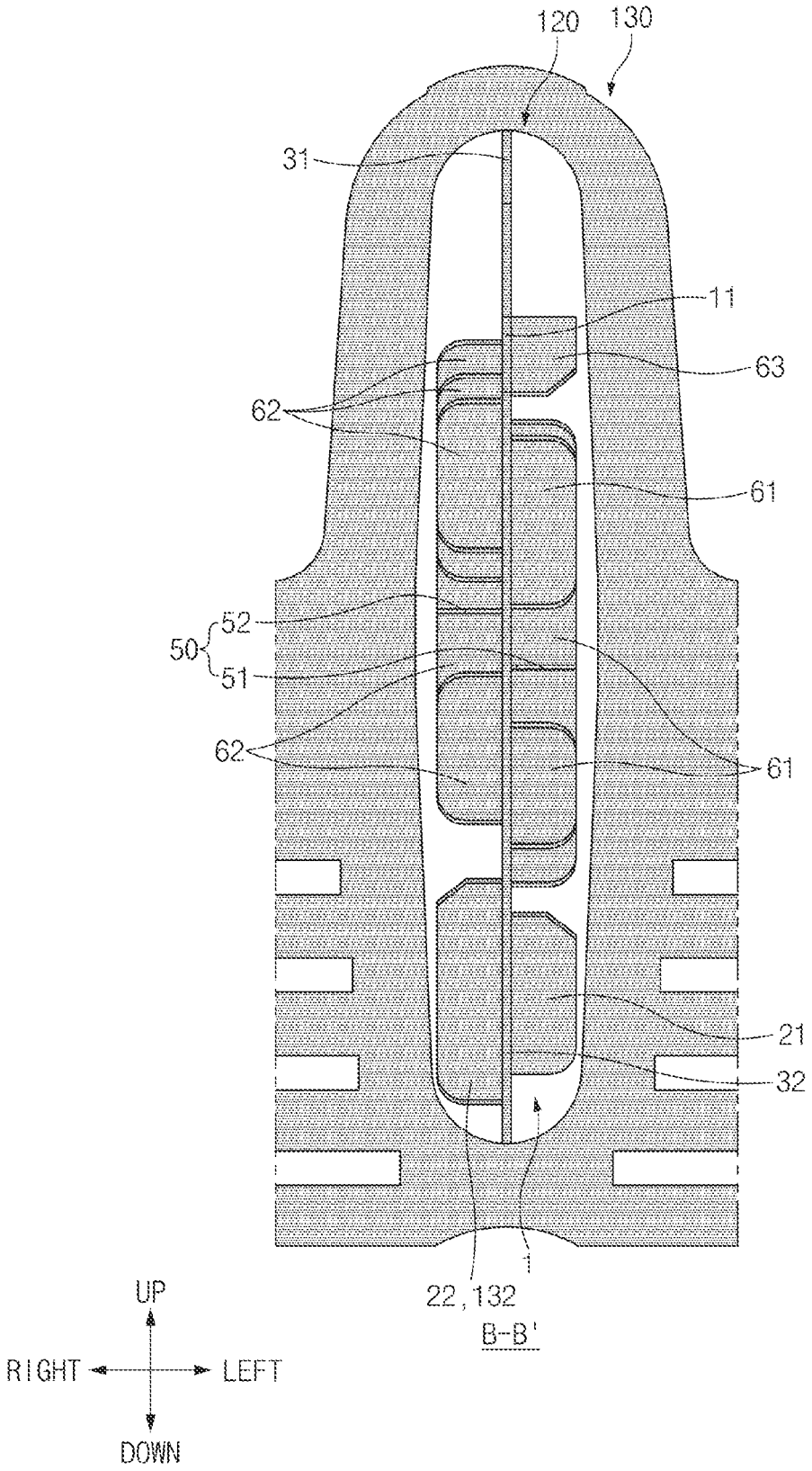
FIG. 9 is a view illustrating a turbulator and a tube according to an embodiment of the present disclosure.

FIGS. 5 and 6 are perspective views of a turbulator 1 according to an embodiment of the present disclosure. FIG. 7 is a side view of a turbulator 1 according to an embodiment of the present disclosure. FIG. 8 is a front view of a turbulator 1 according to an embodiment of the present disclosure. FIG. 9 is a view illustrating a turbulator 1 and a tube 120 according to an embodiment of the present disclosure.

The heat exchanger according to the embodiment of the present disclosure may be constituted by applying the turbulator 1 according to the embodiment of the present disclosure to the heat exchanger (100 of FIG. 1). The heat exchanger according to the embodiment of the present disclosure may have the same configuration as the heat exchanger (100 of FIG. 1), except that the exemplary turbulator (140 of FIGS. 3 and 4) is replaced by the turbulator 1 according to the embodiment of the present disclosure, and thus a description of the other elements will be omitted.

The turbulator 1 is an element that is inserted into the tube 120 of the heat exchanger 100 that heats the water through heat exchange with the combustion gas for turbulence of the water. For turbulence of the water, the turbulator 1 may have elements that artificially hinder flows of the water in the tube 120. The turbulator 1 may include a body part 11, and may further include a heightwise support part 30 and a leftward/rightward support part 50.

A height of a profile obtained by cutting an inner surface of the tube 120, into which the turbulator 1 is inserted, by a plane that is perpendicular to the water flow direction D1 with respect to the upward/downward direction is larger than a width of the profile with respect to the leftward/rightward direction so that the flat tube 120 may be constituted. In detail, when a value obtained by dividing the width of the profile of the inner surface of the tube 120 with respect to the leftward/rightward direction by the height of the profile with respect to the upward/downward direction is referred to as an aspect ratio, the aspect ratio of the tube 120 may be not less than 0.15 and not more than 0.3. The tube 120 has a profile that is long in the upward/downward direction and thus heat may be easily exchanged in a relationship with the combustion gas flowing in the upward/downward direction.

Heightwise Support Part (30)

The heightwise support part 30 is a part that supports the body part 11 in the tube 120. To support the body part 11, the heightwise support part 30 includes an upper support portion 31 and a lower support portion 32 that extend from the body part 11 to the upper side and the lower side, respectively. The body part 11 may be prevented from contacting the inner surface of the tube 120 and may be spaced apart from the inner surface of the tube 120 at a specific interval along the upward/downward direction by locating the heightwise support part 30 such that the heightwise support part 30 contacts the inner surface of the tube 120 earlier than the body part 11 or is located closer to the inner surface of the tube 120 than the body part 11.

The heightwise support part 30 may be disposed at a distal end on a side that is close to the water flow direction D1 and at a distal end on a side that is opposite to the side of the water flow direction D1. That is, as illustrated, two upper support portions 31 may be disposed at opposite ends of the body part 11, respectively, and two lower support portions 32 may be disposed at opposite ends of the body part 11, respectively. However, the number and disposition locations of the heightwise support parts 30 are not limited thereto.

The distal ends of the upper support portion 31 and the lower support portion 32 are branched to two sides as illustrated, and may be bent in opposite directions along the leftward/rightward direction. The bent distal ends may contact the upper and lower sides of the inner surface of the tube 120 to stably support the body part 11.

Leftward/Rightward Support Part (50)

The leftward/rightward support part 50 refers to a part that protrudes from the body part 11 in the leftward/rightward direction such that the body part 11 is maintained in a state, in which it is spaced apart from the inner surface of the tube 120 with respect to the leftward/rightward direction. A plurality of leftward/rightward support parts 50 may be disposed in the body part 11 while being arranged along the water flow direction D1.

The leftward/rightward support part 50, as illustrated, may have a plurality of left support portions 51 protruding from the body part 11 to the left side and a plurality of right support portions 52 of a shape protruding from the body part 11 to the right side. As illustrated, the right support portions 52 may be disposed to be spaced apart from the left support portions 51 to the upper side, but the disposition is not limited thereto.

The leftward/rightward support part 50 may have a plate shape that is perpendicular to the upward/downward direction. The body part 11 is penetrated as in the shape of the leftward/rightward support part 50 to have leftward/rightward openings 510 and 520 and may be bent along the leftward/rightward direction so that the leftward/rightward support part 50 may be formed. Accordingly, the left support portion 51 may protrude form a portion of a circumference of the left opening 510, which is parallel to the water flow direction D1, and the left support portion 52 may protrude from a portion of a circumference of the right opening 520, which is parallel to the water flow direction D1. The leftward/rightward support part 50 may have a substantially triangular shape as illustrated, but the shape is not limited thereto.

Unlike the shape of the leftward/rightward support part 50 included in the exemplary turbulator 140, the leftward/rightward support part 50 of the turbulator 1 according to the embodiment of the present disclosure has a flat plate shape, and a problem of cracks may be reduced during mold punching.

Body Part (11)

The body part 11 has a plate shape that extends in the water flow direction D1, and may be inserted into the tube 120 such that the heightwise direction thereof is disposed in the upward/downward direction. That is, the body part 11 may have a plate shape that is perpendicular to the leftward/rightward direction. The body part 11 may have a substantially rectangular shape.

A lower end protrusion 20 may be formed to extend from the body part 11 to the lower side, the heightwise support part 30 may be formed to extend from the body part 11 along the upward/downward direction, and intermediate wings 61 and 62, an upstream side wing part 70, and the leftward/rightward support part 50 may be formed to extend from the body part 11 in the leftward/rightward direction.

The turbulator 1 according to the embodiment of the present disclosure forms the flow space, and may achieve a flow rate, which is increased as compared with the flow rate on the upper side of the turbulator (140 of FIGS. 3 and 4) that may be obtained from the exemplary turbulator (140 of FIGS. 3 and 4). Accordingly, local heating that may occur as the flow velocity is decreased due to the decrease in the flow rate in the exemplary turbulator (140 of FIGS. 3 and 4) may be reduced due to a local increase in flow rate and thus an increase of flow velocity in the turbulator 1 according to the embodiment of the present disclosure, and boiling noise may be reduced.

The upper end of the body part 11 may include an upper end linear portion 111 formed along a horizontal line, and an upper recess 1110 formed to be recessed to the lower side as compared with the upper end linear portion 111. A plurality of upper end recesses 1110 may be formed, and may have a triangular shape when viewed along the leftward/rightward direction. An upper end wing 63 that is a portion of the wing and protrudes in at least one direction of the leftward/rightward direction along one corner of the upper end groove 1110. As illustrated, the upper end wing 63 may be formed at, among the corners of the upper end recess 1110, a corner that is inclined upwards with respect to the water flow direction D1 and protrude only to the left side, but the corner, at which the upper end wing 63 is disposed, and the direction, in which the upper end wing 63 protrudes, are not limited thereto.

The width of the upper end wing 63 with respect to the leftward/rightward direction may be larger than a half of a distance from the body part 11 to an inner surface of the tube 120 along the left side or the right side.

Lower End Protrusion (20)

The lower end protrusion 20 is a part for inducing turbulence of water, and protrudes from the lower end of the body part 11 to the lower side. The lower end protrusion 20 may protrude from the lower end of the body part 11 in a "V" shape. The lower end protrusion 20 may include lower end wings 21 and 22 and a lower end protrusion body 23. The lower end wings 21 and 22 may include a first lower end wing 21 and a second lower end wing 22.

The lower end protrusion body 23 may have a plate shape that extends from the lower end of the body part 11 in the water flow direction D1 and the lower side and is parallel to the body part 11. The lower end wings 21 and 22 may protrude from the lower end protrusion body 23 in the leftward/rightward direction. In detail, the first lower end wing 21 may protrude from the lower end protrusion body 23 to the left side, and the second lower end wing 22 may protrude from the lower end protrusion body 23 to the right side.

The first lower end wing 21 may extend from the lower end of the body part 11 in the water flow direction D1 and to the lower side, and may protrude to the left side. The second lower end wing 22 may extend in the water flow direction D1 and to the upper side, may protrude to the right side, and may be connected to the lower end of the body part 11. The second lower end wing 22 may extend from the lower end of the lower end protrusion body 23 in a direction that is inclined upwards with respect to the water flow direction D1, and may connected the lower end of the lower end protrusion body 23 and the lower end of the body part 11.

Because the second lower end wing 22 and the lower end protrusion body 23 protrude from the lower ends of the extension part and are connected to each other, the lower end protrusion 20 in the "V" shape may be formed when viewed along the leftward/rightward direction, and the lower end protrusion 20 and the lower end of the extension part may surround the triangular hole.

The first lower end wing 21 may be formed to protrude from a portion of, among the two corners of the lower end protrusion body 23, which extend in the water flow direction D1 and toward the lower side, the corner located on the lower side to the left side. Furthermore, because the second lower end wing 22 extends to the lower end of the lower end protrusion body 23 and the first lower end wing 21 does not extend to the lower end of the lower end protrusion body 23, the second lower end wing 22 and the first lower end wing 21 may not meet each other. The shapes of the lower end wings 21 and 22 may be provided to prevent the first lower end wing 21 and the second lower end wing 22 from excessively hindering the flows of the water as the first lower end wing 21 and the second lower end wing 22 block a part corresponding to the lower side of the inside of the tube 120.

The width, by which the lower end wings 21 and 22 protrude from the extension part to the left side or the right side, may be larger than a half of the distance from the extension part to the inner surface of the tube 120 along the left side or the right side. Accordingly, the lower end wings 21 and 22 may maximally approach the inner surface of the tube 120, increasing the effect of hindering the flows of the water and allowing the heat to be exchanged better.

The lower end of the body part 11 may include a lower end linear portion 112 formed along a line that is parallel to the above-described horizontal line, and a lower end recess 1120 formed to be recessed to the upper side as compared with the lower end linear portion 112. A plurality of lower end grooves 1120 may be formed, and may have a triangular shape when viewed along the leftward/rightward direction. An auxiliary wing that protrudes in any one direction of the leftward/rightward direction may be formed along one corner of the lower end recess 1120. The auxiliary wing may be formed along, among the corners of the lower end recess 1120, the corner connected to the lower end wing 21 and 22, and may have a shape that is continuously connected from the lower end wing 21 and 22. Because the lower end wing 21 and 22 may include the first lower end wing 21 and the second lower end wing 22, the auxiliary wing also may include a first auxiliary wing connected from the first lower end wing 21 and a second auxiliary wing connected from the second lower end wing 22.

Similarly to the lower end wings 21 and 22, the width of the auxiliary wings with respect to the leftward/rightward direction also may be larger than a half of the distance from the body part 11 to the inner surface of the tube 120 along the left side or the right side.

The lower end protrusion 20 includes an upstream side lower end protrusion 13 that protrudes from the lower end of the upstream side portion of the body part 11 with respect to the water flow direction D1 to the lower side. The upstream side lower end protrusion 13 may include an upstream side lower end protrusion plate 131 and an upstream side lower end wing 132. The upstream side lower end protrusion plate 131 may have a plate shape that protrudes from the lower end of the upstream side portion of the body part 11 with respect to the water flow direction D1 to the lower side and is perpendicular to the leftward/rightward direction. Unlike the exemplary turbulator (140 of FIGS. 3 and 4), in which the hole opened in the leftward/rightward direction is formed in the protrusion 142 formed at the lower end thereof and another lower end protrusion 20, the hole is not formed in the upstream side lower end protrusion 13, whereby the water may not flow at a location that is adjacent to the upstream side lower end of the turbulator 1 while crossing the turbulator 1 in the leftward/rightward direction. Accordingly, the flow rate of the upstream side lower end of the turbulator 1 may be prevented from being lost to the left side and the right side as it fails to be induced to the upper end of the turbulator 1.

The upstream side lower end wing 132 may protrude from the upstream side lower end protrusion plate 131 with respect to the water flow direction D1 along at least one direction of the leftward/rightward direction such that the water is guided to the upper side of the body part 11, and may have a shape that extends in a direction that is inclined upwards with respect to the water flow direction D1. Accordingly, by the upstream side lower end wing 132, the water that flows adjacent to the upstream side lower end protrusion 13 may be guided to the upper side. Accordingly, a large amount of water may be guided to the upper side of the turbulator 1 and overheating may be prevented.

The heightwise support part 30 may be connected to the upstream side lower end protrusion 13. This is because one of the lower support portions 32 of the heightwise support part 30 is disposed on an upstream side of the upstream side lower end protrusion 13 with respect to the water flow direction D1. Neither the hole that is opened in the leftward/rightward direction nor the recess that is opened in the leftward/rightward direction is formed between the heightwise support part 30 and the upstream side lower end protrusion 13, whereby the water may be hindered from being lost as it is not induced to the upper end of the turbulator 1 while crossing the turbulator 1 in the leftward/rightward direction.

Upstream Side Wing Part (70)

The upstream side wing part 70 is an element that guides the water to the upper side of the body part 11 on an upstream side of the turbulator 1 with respect to the water flow direction D1. The upstream side wing part 70 may protrude from the upstream side portion of the body part 11 with respect to the water flow direction D1 along at least one direction of the leftward/rightward direction, and may have a shape that extends in a direction that is inclined upwards with respect to the water flow direction D1.

The upstream side wing part 70 may include a plurality of upstream side wings 71 and 72 that are formed in a direction that is inclined upwards with respect to the water flow direction D1, are parallel to each other, and are disposed to be spaced apart from each other. In the embodiment of the present disclosure, the upstream side wing part 70 includes a first upstream side wing 71, and a second upstream side wing 72 that is located on a more downstream side than the first upstream side wing 71 with respect to the water flow direction D1. However, the number of the upstream side wings 71 and 72 may not be limited thereto.

The upstream side wings 71 and 72 may be disposed to protrude from the upstream side openings 710 and 720. The upstream side openings 710 and 720 may pass through the upstream side portion of the body part 11 along the leftward/rightward direction with respect to the water flow direction D1. The upstream side wing part 70 may protrude from a portion of the circumference of the upstream side opening 710 and 720. Accordingly, the number of the upstream side openings 710 and 720 may correspond to the number of the upstream side wings 71 and 72, and the upstream side wings 71 and 72 may be disposed in the upstream side opening 710 and 720, respectively. The upstream side openings 710 and 720 may be formed to pass through the body part 11 in shapes corresponding to the shapes of the upstream side wings 71 and 72, and the upstream side wings 71 and 72 may be formed by bending a penetrated portion of the body part 11 in the leftward/rightward direction. Because the first upstream side wing 71 and the second upstream side wing 72 are present in the embodiment of the present disclosure, the first upstream side opening 710 and the second upstream side opening 720 corresponding to the upstream side wings 71 and 72 may be formed.

As illustrated, the upstream side wings 71 and 72 may have a shape that protrudes, among the corners of the upstream side openings 710 and 720 that are inclined upwards with respect to the water flow direction D1, the corners located on the downstream side with respect to the water flow direction D1. Accordingly, according to the disposition of the upstream side wings 71 and 72, the water that flows on the lower side may be effectively guided toward the upper side.

At least a portion of the two sites of the body part 11, from which, among the plurality of upstream side wings 71 and 72, the two adjacent upstream side wings 71 and 72 protrude, may be disposed to overlap each other along the upward/downward direction. Accordingly, the upstream side wings 71 and 72 may be disposed densely on the upstream side of the body part 11 to effectively guide the water toward the upper end of the body part 11.

Among the plurality of upstream side wings 71 and 72, the two adjacent upstream side wings 71 and 72 may protrude from the body part 11 in opposite directions. In the embodiment of the present disclosure, the first upstream side wing 71 protrudes to the right side, and the second upstream side wing 72 protrudes to the left side. However, the directions, in which the upstream side wings 71 and 72 protrude, are not limited thereto.

The upstream side wing part 70 includes, among the wings protruding from the body part 11 along at least one direction of the leftward/rightward direction, the wings that are closest to the upstream side distal end of the body part 11 with respect to the water flow direction D1, as the upstream side wings 71 and 72. The wings include all of the upstream side wings 71 and 72 and the intermediate wings 61 and 62, and the upstream side wings 71 and 72 are disposed on the upstream side of the intermediate wings 61 and 62. Furthermore, another wing may not be disposed between the upstream side wings 71 and 72 and the upstream side distal end of the body part 11. Accordingly, unlike the exemplary turbulator 1, according to the embodiment of the present disclosure, the wings that are adjacent to the upstream side distal end of the body part 11 are inclined upwards with respect to the water flow direction D1, whereby the water introduced into a periphery of the turbulator 1 may be maximally guided to the upper side before it flows to the lower side.

The turbulator 1 according to the embodiment of the present disclosure may further an upper end protrusion 12 that protrudes from the upper end of the upstream side portion of the body part 11 with respect to the water flow direction D1 to the upper side. The upper end protrusion 12 may be connected to, among the upper support portions 31 of the heightwise support part 30, the upper support portion 131 disposed on the upstream side with respect to the water flow direction D1.

A portion of the upstream side openings 710 and 720 may be formed over the upper end protrusion 12 and the body part 11. In the embodiment of the present disclosure, a portion of the first upstream side opening 710 is formed in the upper end protrusion 12, and the remaining portions are formed in the body part 11. However, according to another modification, a portion of the second upstream side opening 720 also may be disposed in the upper end protrusion 12.

An upper border of the upper end protrusion 12 may extend from the heightwise support part 30 along the water flow direction D1, may extend in a direction that is inclined to the lower side with respect to the water flow direction D1, and may meet the upper end of the body part 11.

Intermediate Wings (61, 62)

The intermediate wings 61 and 62 are wings that protrude from a central area of the body part 11 with respect to the upward/downward direction along at least one direction of the leftward/rightward direction. The intermediate wings 61 and 62 may include a first intermediate wing 61 that protrudes from the body part 11 leftwards and a second intermediate wing 62 that protrudes rightwards. The turbulator 1 may include a plurality of intermediate wings 61 and 62. The intermediate wings 61 and 62 may be disposed to be inclined to the upper side or to the lower side while following the water flow direction D1. The intermediate wings 61 and 62 may be disposed on the more downstream side with respect to the above-described upstream side wing part 70. Because the intermediate wings 61 and 62 have shapes that are inclined with respect to the water flow direction D1, the water may be guided upwards and downwards.

A portion of the body part 11, which is adjacent to the portions, at which the intermediate wings 61 and 62 are formed, may be penetrated to form an intermediate opening 60.

Similarly to the lower end wings 21 and 22, the width of the intermediate wings 61 and 62 with respect to the leftward/rightward direction also may be larger than a half of the distance from the body part 11 to the inner surface of the tube 120 along the left side or the right side.

Modification

Figure 10:
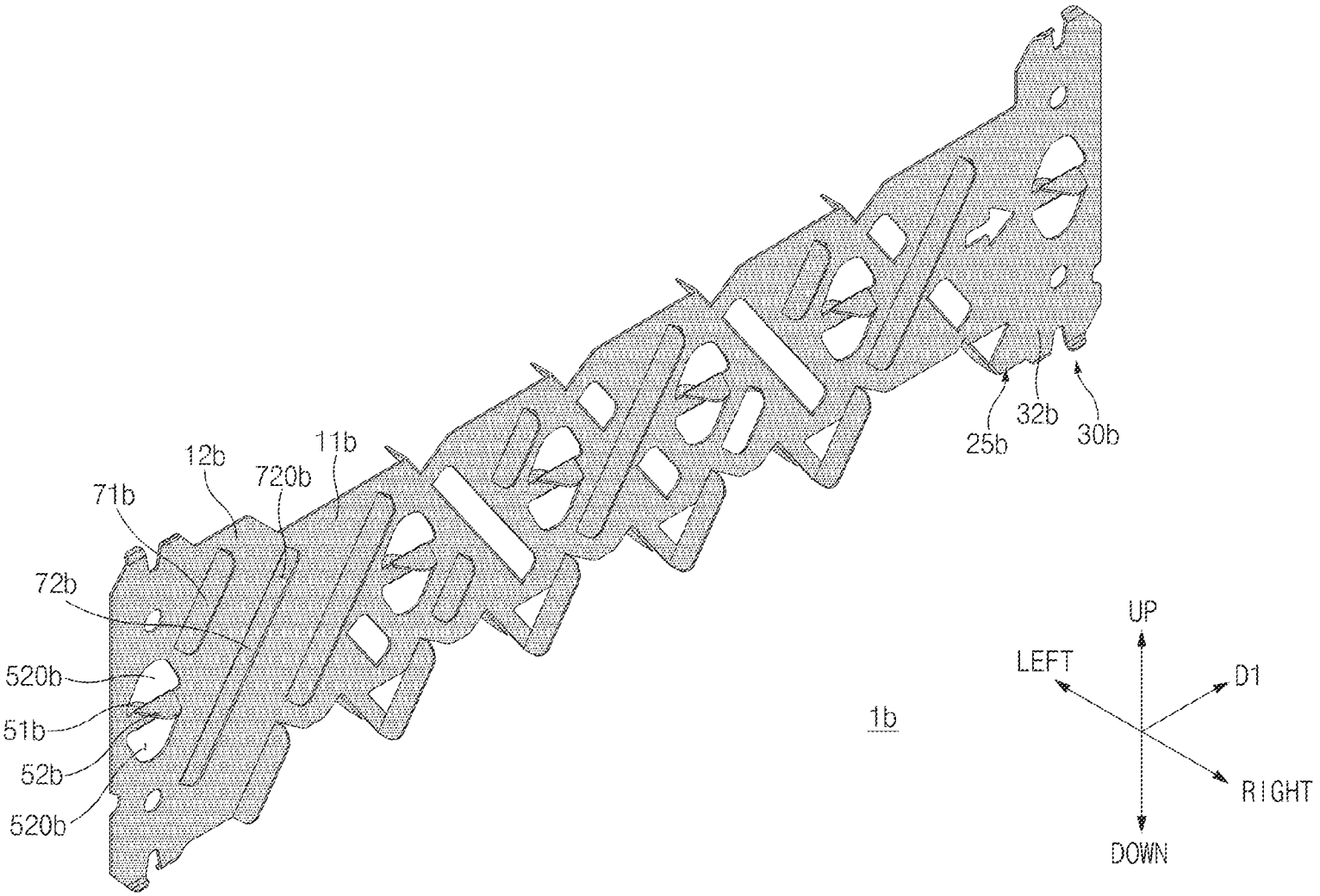
FIGS. 10 and 11 are perspective views of a turbulator according to a modification of an embodiment of the present disclosure.
Figure 11:
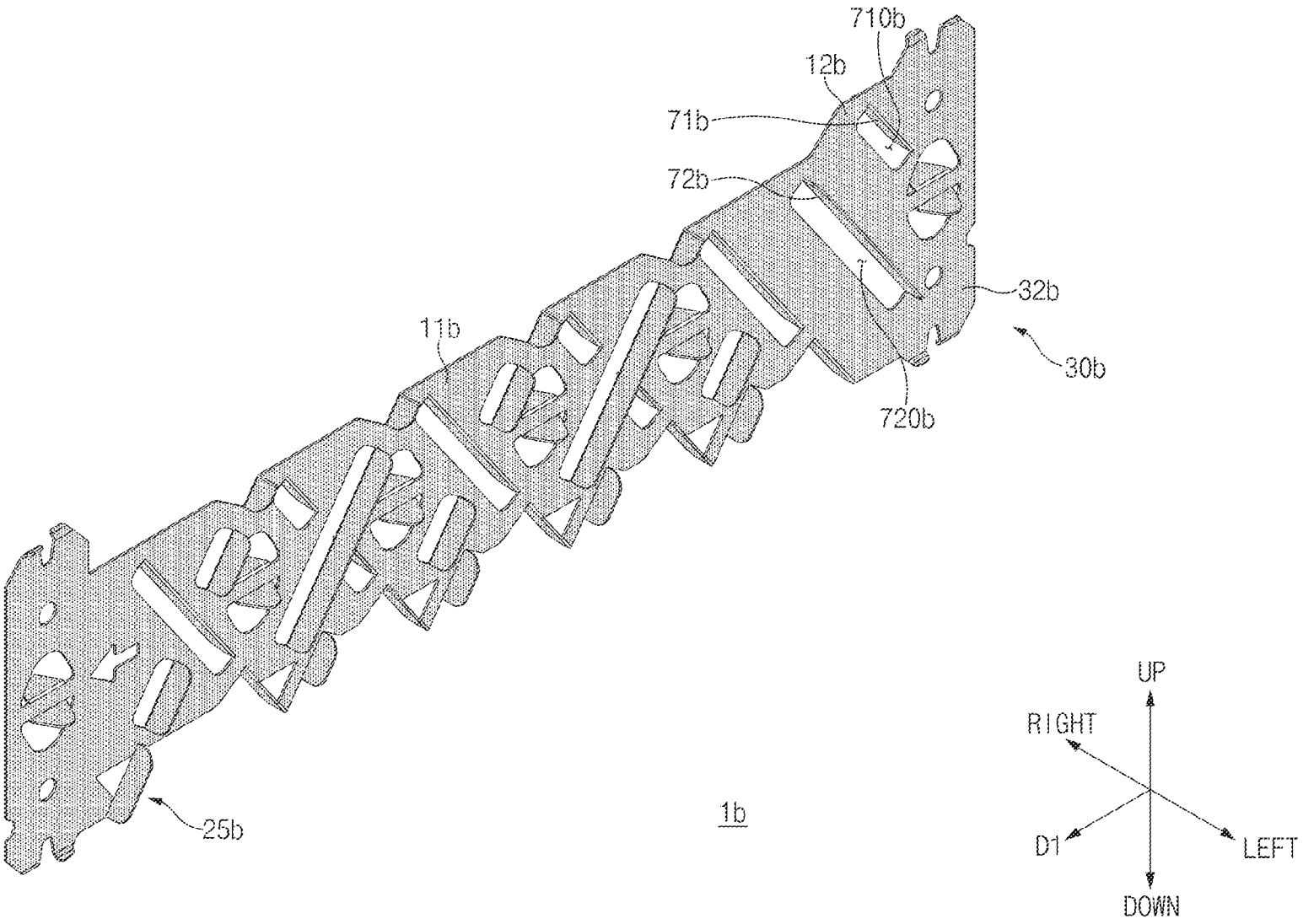
Figure 12:
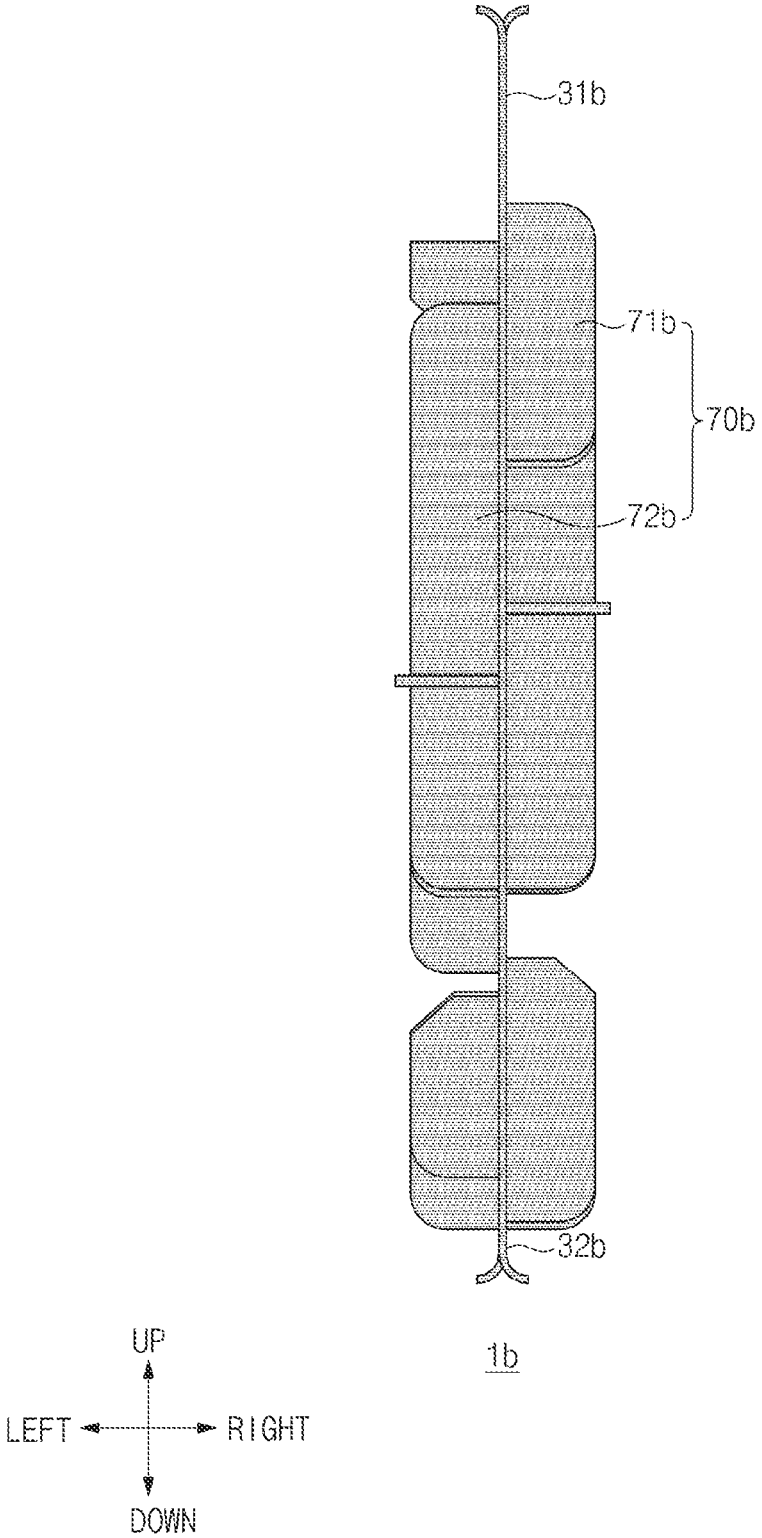
FIG. 12 is a front view of a turbulator according to a modification of an embodiment of the present disclosure.

FIGS. 10 and 11 are perspective views of a turbulator 1*b* according to a modification of an embodiment of the present disclosure. FIG. 12 is a front view of a turbulator 1*b* according to a modification of an embodiment of the present disclosure.

Because the turbulator 1*b* according to the modification of the embodiment of the present disclosure is basically similar to the turbulator 1 according to the embodiment of the present disclosure, the same parts as those of the turbulator 1 according to the embodiment of the present disclosure will be omitted, and only different parts will be further described.

In the turbulator 1*b* according to the modification of the embodiment of the present disclosure, a left support portion 51*b* of the leftward/rightward support part may be disposed at a location that is spaced upwards apart from a right support portion 52*b*. The sizes and shapes of the leftward/rightward openings 510*b* and 520*b* formed in the body part 11*b* may correspond to the sizes and shapes of the left support portion 51*b* and the right support portion 52*b* included in the leftward/rightward support part in the embodiment of the present disclosure, but the sizes of the leftward/rightward openings 510*b* and 520*b* may be larger than the sizes of the left support portion 51*b* and the right support portion 52*b*.

The upstream side wings 71*b* and 72*b* may have a shape that protrudes, among the corners of the upstream side openings 710*b* and 720*b* that are inclined upwards with respect to the water flow direction D1, the corners located on the upstream side with respect to the water flow direction D1. Accordingly, the first upstream side wing 71*b* may be disposed over the upper end protrusion 12*b* and the body part 11*b*.

The lower end protrusion may further include a downstream side lower end protrusion 25*b*. The downstream side lower end protrusion 25*b* may protrude from the lower end of the body part 11*b* on the downstream side with respect to the water flow direction D1 to the lower side. Accordingly, the downstream side lower end protrusion 25*b* may be connected to a lower support portion 32*b* of the heightwise support part 30*b*.

Figure 13:
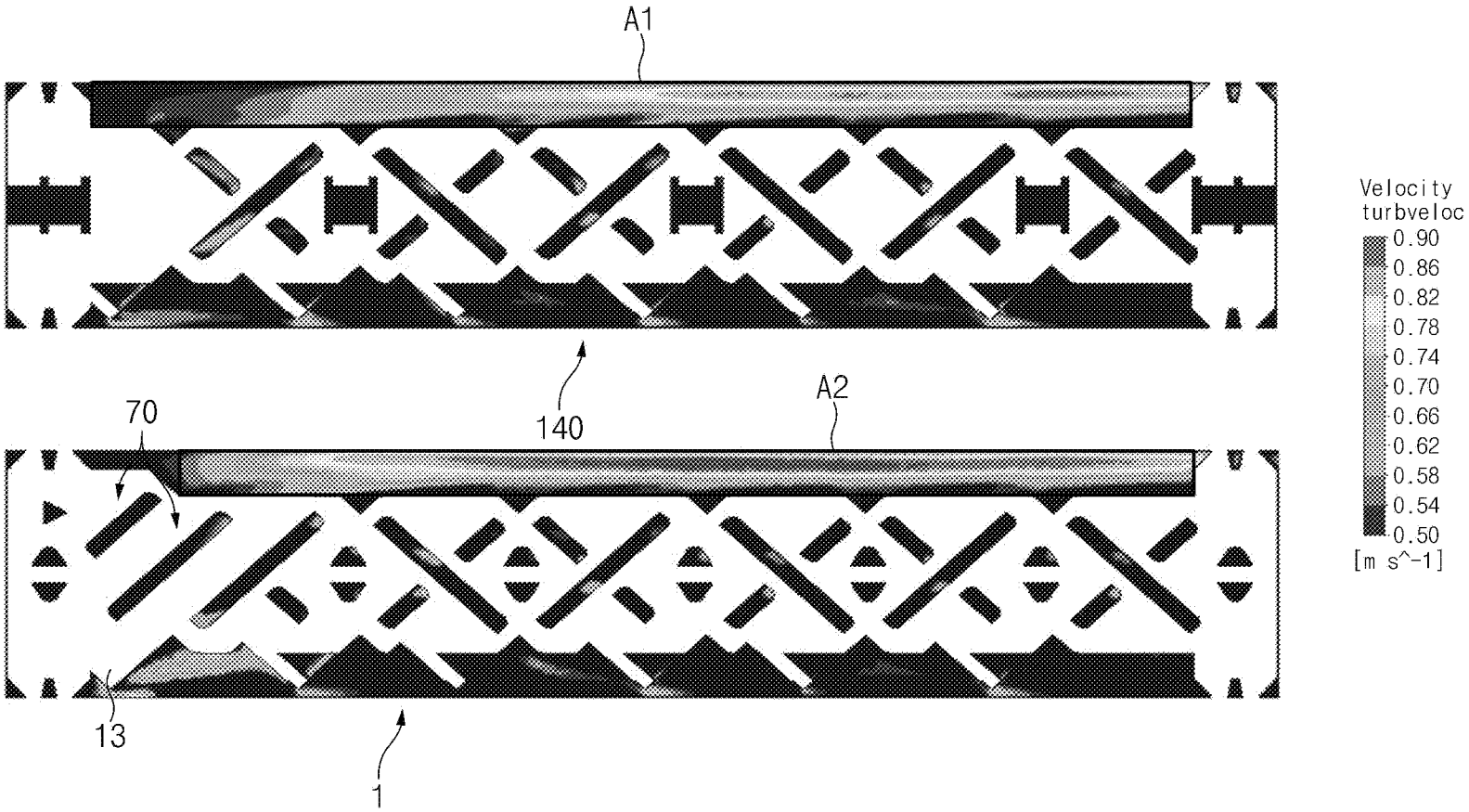
FIG. 13 is a view illustrating a flow velocity profile around a turbulator according to an embodiment of the present disclosure and an exemplary turbulator.

FIG. 13 is a view illustrating a flow velocity profile around a turbulator 1 according to an embodiment of the present disclosure and an exemplary turbulator 140.

Referring to the drawing, a difference between a flow velocity profile in a first flow area A1 that is a flow area at the upper end of the exemplary turbulator 140 and a flow velocity profile in a second flow area A2 that is a flow area at the upper end of the turbulator 1 according to the embodiment of the present disclosure may be identified. It may be identified that the flow velocity on the upstream side of the second flow area A2 is higher than the flow velocity on the upstream side of the first flow area A1 because the amount of the water guided to the upper end of the turbulator 1 according to the embodiment of the present disclosure is larger than that of the exemplary turbulator 140. Furthermore, it may be identified that the flow velocity formed in the second flow area A1 also is higher than the flow velocity in the first flow area A1 as a whole.

Figure 14:
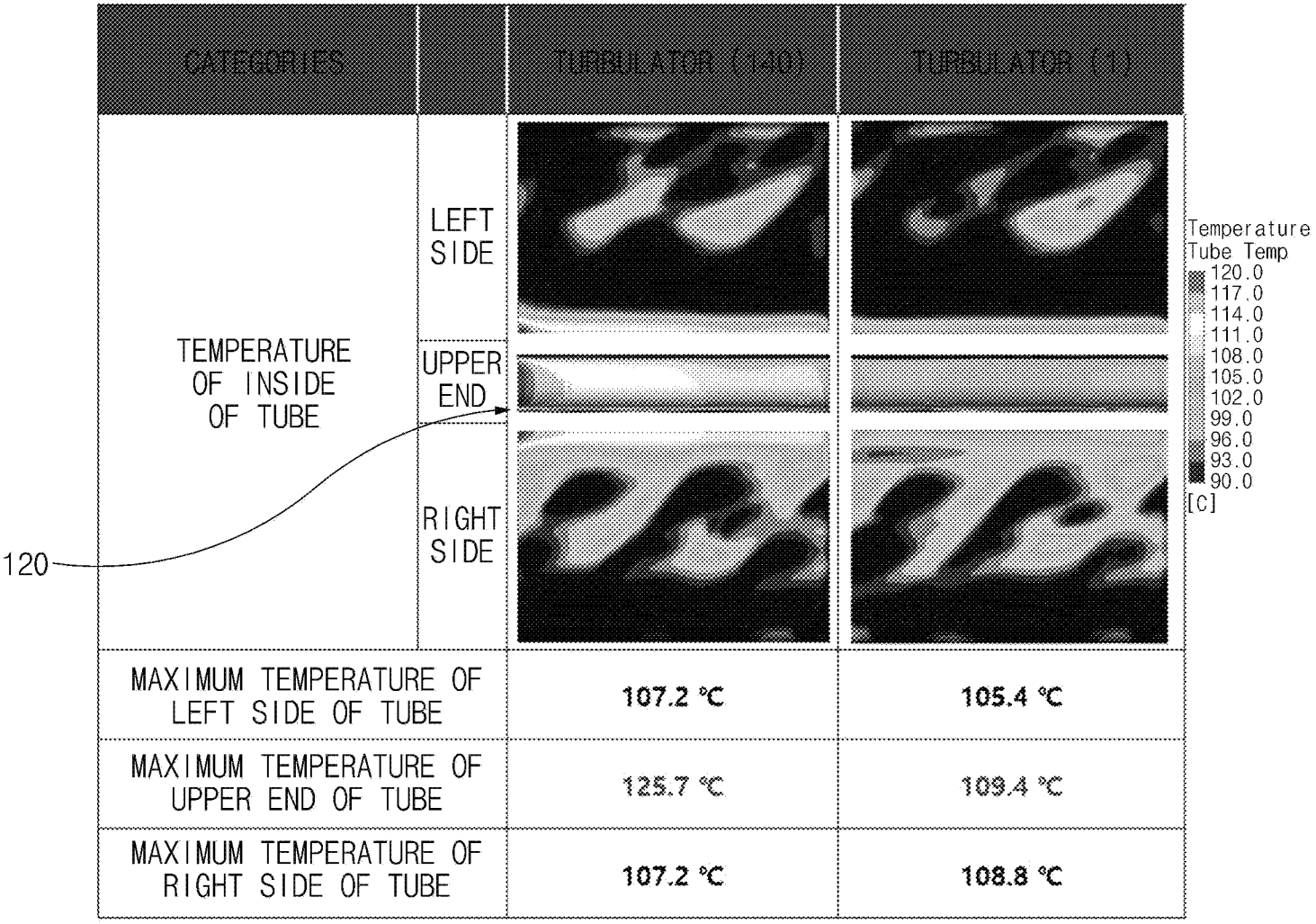
FIG. 14 is a view illustrating distributions of temperatures of insides a tube when a turbulator according to an embodiment of the present disclosure and an exemplary turbulator are used.

FIG. 14 is a view illustrating distributions of temperatures inside a tube 120 when a turbulator 1 according to an embodiment of the present disclosure and an exemplary turbulator 140 are used.

Referring to the drawing, it may be identified that overheating occurs at the upper end of the inside of the tube 120 on the upstream side, causing a high temperature area when the exemplary turbulator 140 is disposed, but a high temperature area is not caused on the inner side of the tube 120 when the turbulator 1 according to the embodiment of the present disclosure is disposed. Referring to the table, when the exemplary turbulator 140 is disposed, the maximum temperatures of the left side, the upper end, and the right side of the tube 120 are 107.2° C., 125.7° C., and 107.2° C., but when the turbulator 1 according to the embodiment of the present disclosure is disposed, the maximum temperatures of the left side, the upper end, and the right side of the tube 120 are 105.4° C., 109.4° C., and 108.8° C. Accordingly, it may be seen that the temperature of the upper end of the tube is relatively less different from the other parts of the tube 120 when the turbulator 1 according to the embodiment of the present disclosure is used.

Figure 15:
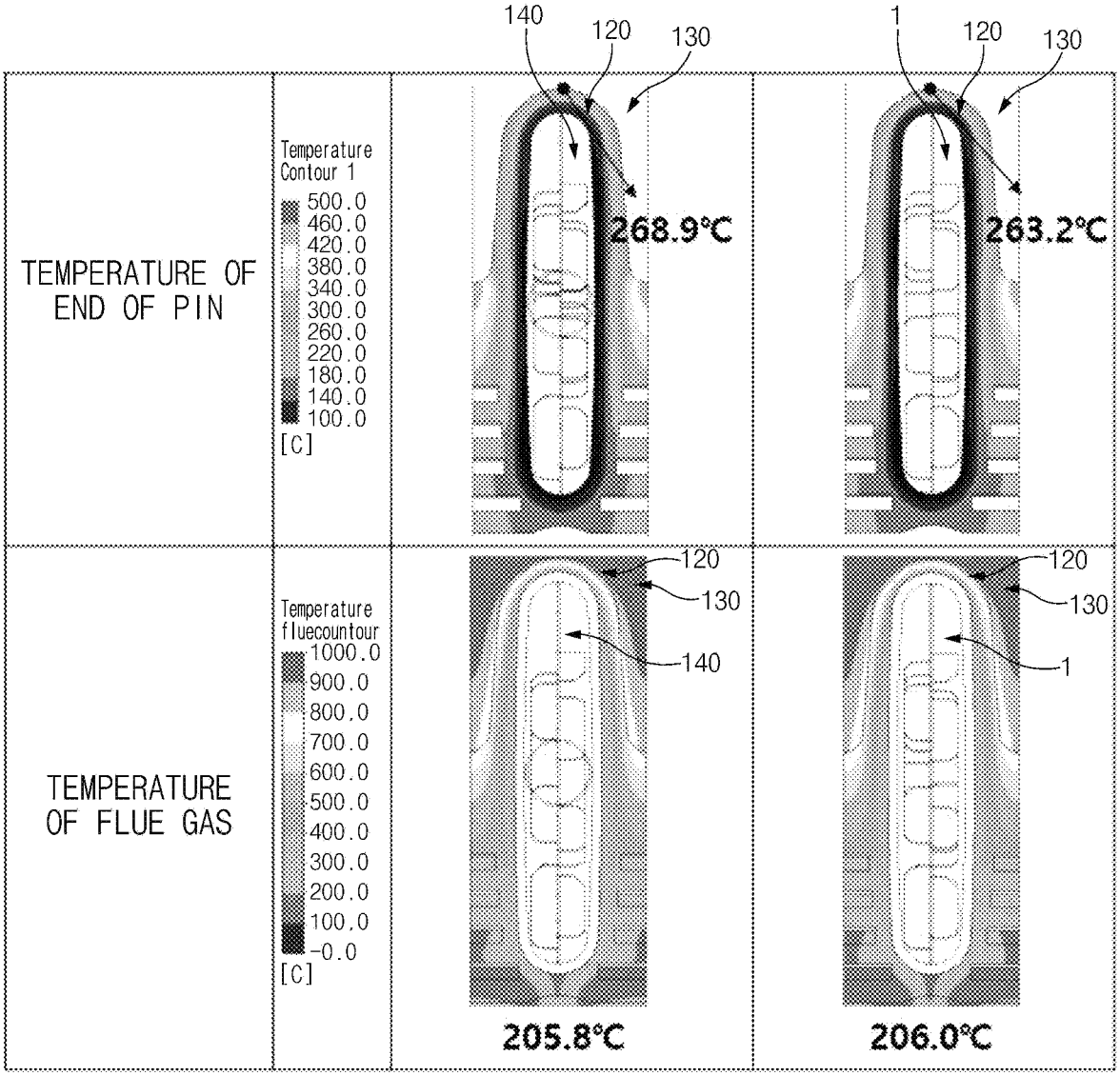
FIG. 15 is a view illustrating temperatures at ends of pins and temperatures of a combustion gas when a turbulator according to an embodiment of the present disclosure and an exemplary turbulator are used.

FIG. 15 is a view illustrating temperatures at ends of pins 130 and temperatures of a combustion gas when a turbulator 1 according to an embodiment of the present disclosure and an exemplary turbulator 140 are used.

Referring to the drawing, it may be seen that the upper end of the pin 130 inserted into the tube 120 is locally overheated to have a temperature of 268.9° C. when the exemplary turbulator 140 is disposed, but the upper end of the pin 130 has a relatively lower temperature of 263.2° C. when the turbulator 1 according to the embodiment of the present disclosure is disposed.

Accordingly, local heating that may occur on the upper side of the tube of the heat exchanger may be prevented, boiling generated due to overheating may be reduced, and boiling noise may be restrained.

Although it may have been described until now that all the elements constituting the embodiments of the present disclosure are coupled to one or coupled to be operated, the present disclosure is not essentially limited to the embodiments. That is, without departing from the purpose of the present disclosure, all the elements may be selectively coupled into one or more elements to be operated. Furthermore, because the terms, such as "comprising", "including", or "having" may mean that the corresponding element may be included unless there is a specially contradictory description, it should be construed that another element is not extruded but may be further included. In addition, unless defined otherwise, all terms used herein, including technical or scientific terms, have the same meanings as those generally understood by those skilled in the art to which the present disclosure pertains. The terms, such as the terms defined in dictionaries, which are generally used, should be construed to coincide with the context meanings of the related technologies, and are not construed as ideal or excessively formal meanings unless explicitly defined in the present disclosure.

The above description is a simple exemplification of the technical spirits of the present disclosure, and the present disclosure may be variously corrected and modified by those skilled in the art to which the present disclosure pertains without departing from the essential features of the present disclosure. Accordingly, the embodiments disclosed in the present disclosure is not provided to limit the technical spirits of the present disclosure but provided to describe the present disclosure, and the scope of the technical spirits of the present disclosure is not limited by the embodiments. Accordingly, the technical scope of the present disclosure should be construed by the attached claims, and all the technical spirits within the equivalent ranges fall within the scope of the present disclosure.

What is claimed is:

1. A turbulator inserted into a tube of a heat exchanger that heats water through heat exchange with a combustion gas for turbulence of the water, the turbulator comprising:

when the water flows horizontally along a water flow direction along the tube and the combustion gas flows vertically from an upper side to a lower side to cross the tube, and a direction that is perpendicular to both the water flow direction and an upward and downward direction is defined as a leftward and rightward direction, a body part extending along the water flow direction, having a plate shape that is perpendicular to the leftward and rightward direction, and inserted into the tube;

a lower end protrusion protruding from a lower end of the body part and configured to induce turbulence of the water;

a heightwise support part including an upper support portion and a lower support portion extending from the body part to the upper side and the lower side to support the body part in the tube; and an upstream side wing part protruding from an upstream side portion of the body part with respect to the water flow direction along at least one direction of the leftward and rightward direction and extending in a direction that is inclined upwards with respect to the water flow direction such that the water is guided to an upper side of the body part, wherein the lower end protrusion includes an upstream side lower end protrusion protruding from a lower end of the upstream side portion of the body part with respect to the water flow direction to the lower side, wherein the heightwise support part is disposed on an upstream side of the upstream side lower end protrusion with respect to the water flow direction and is connected to the upstream side lower end protrusion, and wherein the upstream side lower end protrusion includes an upstream side lower end protrusion plate protruding from the lower end of the upstream side portion of the body part to the lower side and from the heightwise support part along the water flow direction and having a plate shape that is perpendicular to the leftward and rightward direction.

2. The turbulator of claim 1, wherein the upstream side wing part includes a plurality of upstream side wings formed in the direction that is inclined upwards with respect to the water flow direction and disposed to be spaced apart from each other while being parallel to each other.

3. The turbulator of claim 2, wherein at least portions of two sites of the body part, from which, among the plurality of upstream side wings, two adjacent upstream side wings protrude, are disposed to overlap each other along the upward and downward direction.

4. The turbulator of claim 2, wherein among the plurality of upstream side wings, the two adjacent upstream side wings protrude from the body part in opposite directions.

5. The turbulator of claim 1, wherein the upstream side wing part includes, among the wings protruding from the body part along at least one direction of the leftward and rightward direction, a wing that is closest to an upstream side distal end of the body part with respect to the water flow direction as the upstream side wing.

6. The turbulator of claim 1, wherein an upstream side opening is formed at an upstream side portion of the body part with respect to the water flow direction to pass through the body part along the leftward and rightward direction, and wherein the upstream side wing part protrudes from a portion of a circumference of the upstream side opening.

7. The turbulator of claim 6, further comprising:

an upper end protrusion protruding from an upper end of the upstream side portion of the body part with respect to the water flow direction to the upper side, wherein a portion of the upstream side opening is formed over the upper end protrusion and the body part.

8. The turbulator of claim 7, wherein the heightwise support part is disposed on an upstream side of the upper end protrusion with respect to the water flow direction and is connected to the upper end protrusion.

9. The turbulator of claim 1, wherein the lower end protrusion is configured to induce turbulence of the water.

10. The turbulator of claim 9, wherein the upstream side lower end protrusion further includes an upstream side lower end wing protruding from the upstream side lower end protrusion plate with respect to the water flow direction along at least one direction of the leftward and rightward direction and extending in a direction that is inclined to the upper side with respect to the water flow direction such that the water is guided to the upper side of the body part.

11. The turbulator of claim 1, further comprising:

a leftward and rightward support part protruding from the body part in the leftward and rightward direction such that the body part is maintained in a state, in which the body part is spaced apart from an inner surface of the tube with respect to the leftward/rightward direction, wherein the leftward/rightward support part has a plate shape that is perpendicular to the upward and downward direction.

* * * * *